US006505113B2

(12) United States Patent
Eichenseher et al.

(10) Patent No.: US 6,505,113 B2
(45) Date of Patent: Jan. 7, 2003

(54) CIRCUIT FOR CONTROLLING AT LEAST ONE ELECTROMECHANICALLY ACTIVATED INLET VALVE AND AT LEAST ONE ELECTROMECHANICALLY ACTIVATED OUTLET VALVE OF AN INTERNAL COMBUSTION ENGINE

(75) Inventors: Volker Eichenseher, Beratzhausen (DE); Karl-Heinz Ebeling, München (DE); Andreas Hartke, München (DE); Achim Koch, Tegernheim (DE); Wolfgang Menzel, Dachau (DE); Franz Queisser, Regensburg (DE); Thomas Seidenfuss, Massenhausen (DE); Markus Teiner, Regensburg (DE); Thomas Vogt, Regensburg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/033,236

(22) Filed: Oct. 22, 2001

(65) Prior Publication Data

US 2002/0072846 A1 Jun. 13, 2002

Related U.S. Application Data

(63) Continuation of application No. PCT/DE00/01250, filed on Apr. 20, 2000.

(30) Foreign Application Priority Data

Apr. 21, 1999 (DE) ..... 199 18 095

(51) Int. Cl.[7] ..... F02D 41/20
(52) U.S. Cl. ..... 701/114; 701/115; 123/90.11
(58) Field of Search ..... 701/102, 114, 701/115; 123/90.11

(56) References Cited

U.S. PATENT DOCUMENTS

| | | | | |
|---|---|---|---|---|
| 5,190,013 A | * | 3/1993 | Dozier | 123/90.11 |
| 5,964,192 A | * | 10/1999 | Ishii | 123/90.11 |
| 6,196,172 B1 | * | 3/2001 | Cosfeld et al. | 123/90.11 |

FOREIGN PATENT DOCUMENTS

| | | |
|---|---|---|
| DE | 195 18 056 A1 | 11/1996 |
| DE | 195 26 683 A1 | 1/1997 |
| DE | 297 12 502 U1 | 10/1997 |
| DE | 197 53 275 A1 | 6/1999 |
| EP | 0 376 716 A1 | 7/1990 |
| EP | 0 724 067 A1 | 7/1996 |
| JP | 61 076 713 | 4/1986 |

OTHER PUBLICATIONS

Lawrenz, W. (ed.): "CAN Controller Area Network", Hüthig Verlag, Heidelberg, Germany, 1994, pp. 34–46.

* cited by examiner

*Primary Examiner*—Andrew M. Dolinar
(74) *Attorney, Agent, or Firm*—Laurence A. Greenberg; Werner H. Stemer; Ralph E. Locher

(57) ABSTRACT

In order to control electromechanically activated charge cycle valves, a circuit is provided in which placement control elements actuate an output stage for the electromechanically activated charge cycle valves and control a gentle placement of the charge cycle valves in a respective end position. For the purpose of communication with the operational control unit of the internal combustion engine, a digital communications computer is provided which provides the placement control element with timing signals. As a result, the placement control elements are freed of communications functions and can be dedicated to performing the placement control in real time.

11 Claims, 2 Drawing Sheets

CIRCUIT FOR CONTROLLING AT LEAST ONE ELECTROMECHANICALLY ACTIVATED INLET VALVE AND AT LEAST ONE ELECTROMECHANICALLY ACTIVATED OUTLET VALVE OF AN INTERNAL COMBUSTION ENGINE

CROSS-REFERENCE TO RELATED APPLICATION

This application is a continuation of copending International Application No. PCT/DE00/01250, filed Apr. 20, 2000, which designated the United States and was not published in English.

BACKGROUND OF THE INVENTION

FIELD OF THE INVENTION

The invention relates to a circuit for controlling at least one electromnechanically activated inlet valve and at least one electromechanically activated outlet valve of an internal combustion engine.

Internal combustion engines whose charge cycle valves are activated electromechanically are known. In contrast to camshaft-activated valves, these valves are actuated so as to open and close as a function of the rotational position of the crankshaft; there is no fixed mechanically coupling to the crankshaft. Inlet electromechanical controlling elements which are charge cycle valves are known, for example, from German Patent DE 297 12 502 U1 and Published, European Patent Application EP 0 724 067 A1. They have a position of rest, which is located between a closed position and an opened position and after which they can be deflected by electromagnets.

In order to open or close a valve, the respective winding is energized, the necessary current being greater in a capture phase than in a holding phase in which the valve is held in an end position.

If the respective electromagnet is simply provided with current, a valve plate impacts on the valve seat at a high speed, which generates noise and promotes wear. In order to avoid this, the impact speed should be reduced. Mechanical stop damping has been investigated in this regard.

However, the energization is advantageously regulated in a suitable way, which, however, requires a relatively complex control algorithm because the control has to take place in real time. For example, the time period available for controlling the impact speed is only a few milliseconds.

Whereas in conventional camshaft-actuated valve drive the control times are not predefined in the operational control unit of the internal combustion engine, it is necessary to calculate and predefine appropriate control times in electromechanically activated valves.

SUMMARY OF THE INVENTION

It is accordingly an object of the invention to provide a circuit for controlling at least one electromechanically activated inlet valve and at least one electromechanically activated outlet valve of an internal combustion engine which overcomes the above-mentioned disadvantages of the prior art devices of this general type, which permits the charge cycle valves to be activated in accordance with values predefined by the operational control unit of the internal combustion engine with the impact speed controlled in real time.

With the foregoing and other objects in view there is provided, in accordance with the invention, a circuit for controlling valves, including at least one electromechanically activated inlet valve and at least one electromechanically activated outlet valve, of a cylinder of an internal combustion engine. The circuit contains at least one placement control element having a plurality of output stages connected to electromagnets of the valves. At least one of the output stages is connected to each of the electromagnets of the valves. The placement control element receives timing signals and valve position signals. The placement control element actuates the output stages in dependence on the timing signals and, while processing the valve position signals for indicating a position of the valves, the placement control element regulates an energization of the electromagnets to bring about a gentle, low-noise placement of each of the valves to an end position. A digitally operating communications computer for evaluating a crankshaft position signal is connected to the placement control element. A communications connection connects the communications computer to an operational control unit of the internal combustion At engine. The communications computer exchanges data over the communications connection to the operational control unit and generates the timing signals received by the placement control element in dependence on the crankshaft position signal and of the data received from the operational control unit.

The invention is based on the fact that the control of the impact speed is to be separated from the communication with the operational control unit and from the generation of the timing signal from the predefined values of the operational control unit.

Separate placement control elements which are each assigned to one or more electromechanical final controlling elements control the movement sequence of the final controlling elements and thus bring about a gentle, low-noise, i.e. damped placement of the respective charge cycle valve in the end position. The communications computer preferably carries out the communication with the operational control unit of the internal combustion engine via a CAN-BUS and generates the timing signals for the placement control elements from the crankshaft signal, which is also supplied and from the requirements of the operational control unit. The timing signals are each as a rule a digital signal in which the rising edge indicates an opening of the valve and a trailing edge indicates a closing of the valve. For the inlet and outlet valves of each cylinder, a separate timing signal is fed to the respective placement control element in a unidirectional communication. It is also optionally possible for a separate timing signal to be provided for each coil in order to obtain greater room for maneuver when activating the is coils.

Because the communications computer evaluates the crankshaft signal, performs the communication with the operational control unit of the internal combustion engine and generates the timing signals for the placement control elements as a function of the data obtained from the operational control unit, the placement control elements are kept free for the control application and the control is not interrupted by other (communications) functions. In addition, the functions of the placement control can be paralleled by using a plurality of placement control elements, as a result of which the timing becomes less critical for a control algorithm. As a result of the fact that a central communications and timing unit is provided with the communications computer, there is only one communications partner for the other control units and no incorrect synchronizations of the individual placement control elements, and consequently the electromechanically activated charge cycle valves, are possible. Because the placement control elements advantageously operate digitally and are additionally connected to the communications computer by a serial interface and signal via the interface the statuses of the electromechanically activated charge cycle valves to the communications computer, all the statuses are centrally known and available.

In the event of a placement control element failing, the communications computer can issue instructions to deactivate the other two valves of the cylinder, i.e. move them into the closed position. The internal combustion engine can then run in an emergency operating mode without the cylinder and without non-combusted fuel getting into the exhaust track or combustion gases getting into the intake track.

The provision of a plurality of placement control elements also permits all the processors, in particular the processor of the communications computer and that of the placement control elements, used in the circuit to monitor one another.

In one advantageous embodiment, the coils of the electromechanical charge cycle valves are actuated by the placement control elements via AND elements whose second input can be actuated with the timing signal which the communications computer supplies to the placement control element, and the actuation can take place if the placement control element has enabled this by a respective locking element. This has the advantage that the energization of a coil of the electromechanically activated valve is terminated simultaneously with a trailing edge of the respective timing signal. Any offset as a result of programming running times in the placement control element can thus be optionally eliminated.

In accordance with an added feature of the invention, the placement control element is one of a plurality of placement control elements and one of the placement control elements is coupled to the inlet valve and another of the placement control elements is coupled to the outlet valve.

In accordance with an additional feature of the invention, the placement control element has a processor; and a bidirectional communications interface connects the communications computer to the placement control element for exchanging further data.

In accordance with a further feature of the invention, each of the placement control elements detects a position of the valves and signals a malfunction of one of the valves to the communications computer.

In accordance with another feature of the invention, the communications-computer monitors at least one of a temperature of the output stages, a supply voltage of the output stages, a it supply voltage of position sensors used, and a supply voltage of all of the placement control elements.

In accordance with a further added feature of the invention, the communications computer is one of a plurality of communications computers. The inlet valve is one of a plurality of inlet valves and the outlet valve is one of a plurality of outlet valves, and one of the communications computers is provided for all of the inlet valves and another one of the communications computer is provided for all of the outlet valves.

In accordance with a further additional feature of the invention, a housing and an active cooling system connected to the housing are provided. The plurality of placement control elements are disposed with the output stages in the housing.

In accordance with another added feature of the invention, if a valve failure is indicated by one of the placement control elements, the communications computer brings about a deactivation of the other valves of the cylinder in question to a closed position.

In accordance with another additional feature of the invention, the electromagnets each have a winding resulting in a plurality of windings and a feedline connected to each of the windings resulting in a plurality of feedlines. A logic circuit is disposed in the feedlines, the logic circuit receives an associated timing signal so that the logic circuit brings about, directly by the associated timing signal, a direct shutting down of energization of an associated winding.

In accordance with a concomitant feature of the invention, a communications line connects the communications computer to the placement control element. The logic circuit has first AND elements. One of the first AND elements is connected in each of the feedlines to a respective winding and each of the first AND elements has an output connected to the respective winding, a first input connected to the placement control element and a second input. The logic circuit has a second AND element having a first input connected to the communications line, a second input connected to the placement control element, and an output connected to the second input of each of the first AND elements so that, when the second AND element is enabled by the placement control element, a respective one of the timing signals brings about a direct shutting down of the energization of the-respective winding.

Other features which are considered as characteristic for the invention are set forth in the appended claims.

Although the invention is illustrated and described herein as it embodied in a circuit for controlling at least one electromechanically activated inlet valve and at least one electromechanically activated outlet valve of an internal combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
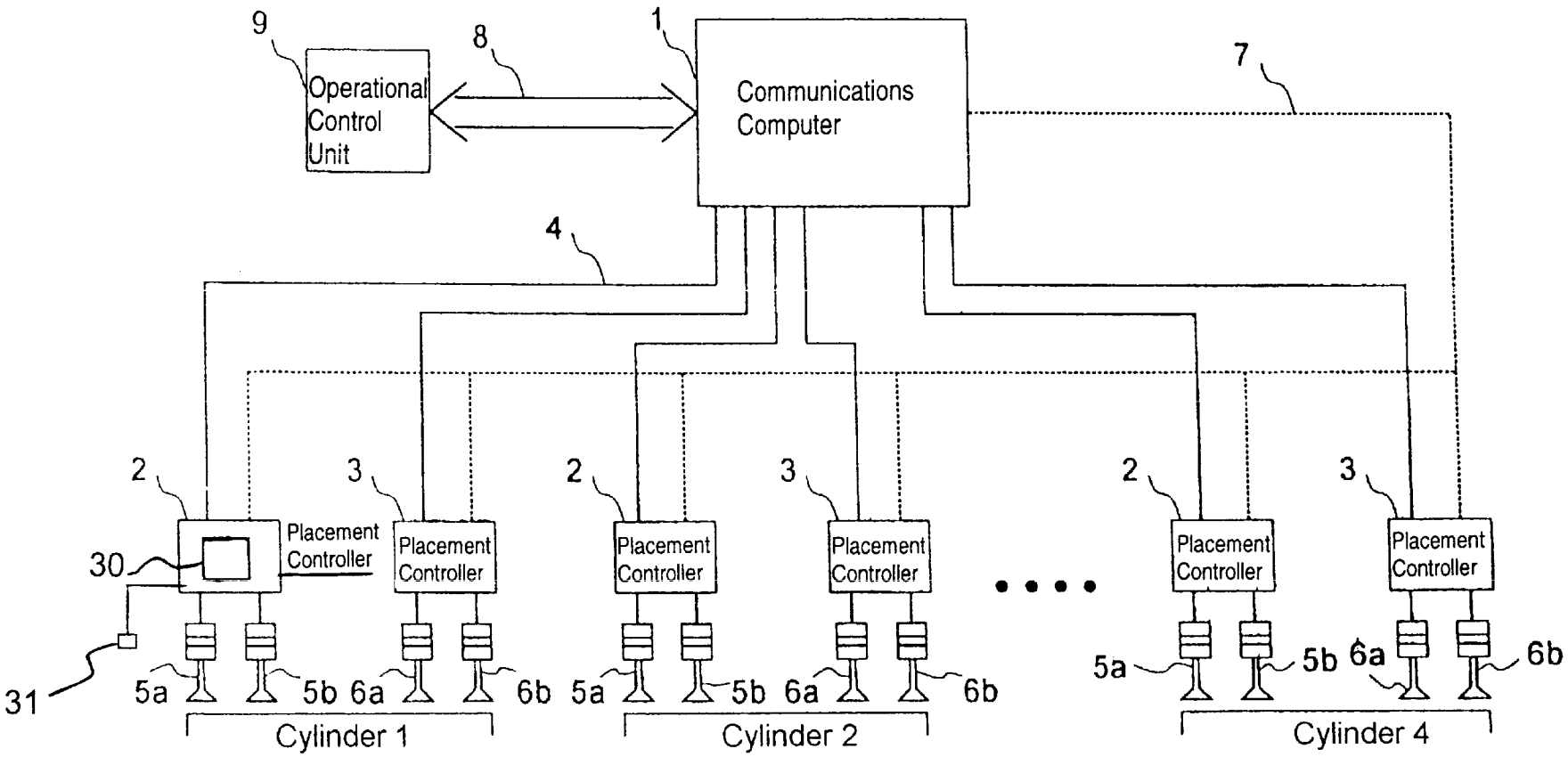
FIG. 1 is a block diagram of a circuit for electromechanically activated charge cycle valves for a four-cylinder internal combustion engine according to the invention.

Referring now to the figures of the drawing in detail and first, particularly, to FIG. 1 thereof, there is shown a circuit that is used to activate electromechanically driven charge cycle valves 5*a*, 5*b*, 6*a*, 6*b*.

Such an electromechanically driven charge cycle valve is described, for example, in German Utility Model 297 12 502 U1. To understand the invention, the only essential factor is that an electromechanically activated charge cycle valve is activated by energizing two coils, one coil being responsible for closing and the other for opening the charge cycle valve. In order to keep the charge cycle valve in the open or closed position, the respective coil is energized with a holding current. In order to move the charge cycle valve into the open or closed position, the respectively required coil has current applied to it, the current being greater in a capture phase than in a subsequent holding phase.

FIG. 1 shows a view of the circuit for a four-cylinder internal combustion engine, but the number of cylinders is to be understood as being only exemplary. In this example, a cylinder has two inlet valves 5*a*, 5*b* and two outlet valves 6*a*, 6*b*. There are separate placement control elements or placement controllers 2 and 3 for the inlet valves 5*a*, 5*b* and for the outlet valves 6*a*, 6*b*, respectively. The placement control elements 2, 3 actuate output stages 32 that bring about the energization of the respective coils of the charge cycle valve 5*a*, 5*b*, 6*a*, 6*b*. A separate output stage 32 is provided for each coil, for example. The placement control element 2, 3 and the output stages 32 are accommodated in a housing, which is connected to a coolant circuit of the internal combustion engine in order to ensure that heat is conducted away evenly.

The placement control element 2, 3 actuates the output stages of the valve 5*a*, 5*b*, 6*a*, 6*b* as a function of a timing signal TS which indicates when the valve has to open or close. There is a separate timing signal TS for the inlet valves 5*a*, 5*b* and for the outlet valves 6*a*, 6*b* of each cylinder. In an internal combustion engine with more than two valves per cylinder, it is also possible to provide a separate timing signal TS for each valve.

The timing signal TS is, for example, a square-wave signal in which the trailing edge indicates the closing and the rising edge indicates the opening of the associated valve. The timing signal TS is fed to the placement control element 2, 3 via a unidirectional communications line 4 from a communications computer 1, which will be described later. The placement control element 2, 3 has a digital processor 30 which controls the energization of the coils by the output stages 32 in such a way that the valve 5*a*, 5*b*, 6*a*, 6*b* is placed gently in the desired end position. In order to move the valve out of one end position into the other, the energization of the coil for engaging the end position, which the valve is to leave is usually switched off and the energization of the winding of the electromagnet for the end position which is to be newly assumed is usually switched on. The current is controlled by the processor 30 of the placement control element 2, 3 in such a way that the valve is placed gently in the new end position. For the control of each valve, the placement control element 2, 3 uses a position signal which provides information on the setting of the respective valve 5*a*, 5*b*, 6*a*, 6*b*. In order to generate the position signals, each electromechanically activated valve 5*a*, 5*b*, 6*a*, 6*b* is provided with its own position sensor 31, such as described, for example, in Published German Patent Application DE 197 53 275 or DE 195 18 056 A1. As an alternative to the position, a reference and control variable of the placement control element can also be any other desired variable. In FIG. 1 the position sensor 31 is shown external to the valve but is normally incorporated in the valve itself and is shown externally for clarity purposes only.

The control of the coil current for capturing the valve 5*a*, 5*b*, 6*a*, 6*b* is described, for example, in basic terms in Published, Non-Prosecuted German Patent Application DE 195 26 683 A1. In this regard, the placement control element 2, 3 L5 measures the actual current through the coil and outputs a setpoint value to the output stage 32. However, instead of the current, it is also possible to use a different variable, which expresses the activation of the final controlling element, for example a driver voltage of the output stage 32.

In addition to controlling the energization of the windings, the placement control element 2, 3 also carries out a plausibility check of the signals, i.e. of the position signal and of the coil energization.

From the latter it is possible, as it is known from Published, Non-Prosecuted German Patent Application DE 195 26 683 A1, to derive a further signal which permits conclusions to be drawn regarding the position of the respective charge cycle valve 5*a*, 5*b*, 6*a*, 6*b* so that the further signal can be used to check the position signal.

The placement control element 2, 3 is connected to the communications computer 1 via a further serial SPI-BUS interface 7 and signals a status of the valves 5*a*, 5*b*, 6*a*, 6*b* and a possible valve failure via the interface 7.

The communications computer 1 is connected to a CAN-BUS 8 and carries out communication with an operational control unit 9 of the internal combustion engine via the CAN-BUS 8. Such a BUS connection is described, for example, in the reference by W. Lawrenz, CAN-Controller Area Network, Huthig Verlag [Publishing House], 1994, ISBN 3-7785-2263-7. The communications computer 1 is advantageously accommodated in the same cooled housing as the placement control elements 2, 3 and the output stages 32. Furthermore, the communications computer 1 receives the crankshaft signal and calculates therefrom, together with the requirements of the operational control unit, the timing signals TS for the placement control elements 2, 3 and outputs them to the placement control elements 2, 3 via the unidirectional communications lines 4.

The communications computer 1 additionally communicates with the placement control elements 2, 3 via the SPI-BUS 7 and it changes the status information and/or failure information. Furthermore, the communications computer 1 monitors the entire electromechanical valve drive, i.e. a temperature of the output stages 32 for the charge cycle valves 5*a*, 5*b*, 6*a*, 6*b*, a supply voltage of the output stages 32 (usually 42 V), a supply voltage of the position sensors 31 (usually 15 V) and a supply voltage of the position control elements 2, 3 (usually 3.3 V).

If a placement control element, for example the placement control element 2 of the inlet valves 5*a*, 5*b* of the cylinder number 1 signals a failure of either one of the output stages 32 or one of the valves 5*a*, 5*b*, or some other damage to the communications computer 1 via the SPI-BUS 7, the communications computer 1 causes the other placement control element of the cylinder, in this example the placement control element 3, to deactivate the other charge cycle valves of the cylinder in question, in this case the outlet valves 6*a*, 6*b* in the closed position. As a result, an emergency operating mode of the internal combustion engine is possible without non-combusted fuel getting into the exhaust track through the cylinder in question, which could lead to undesired detonations and emissions of pollutants.

Figure 2:
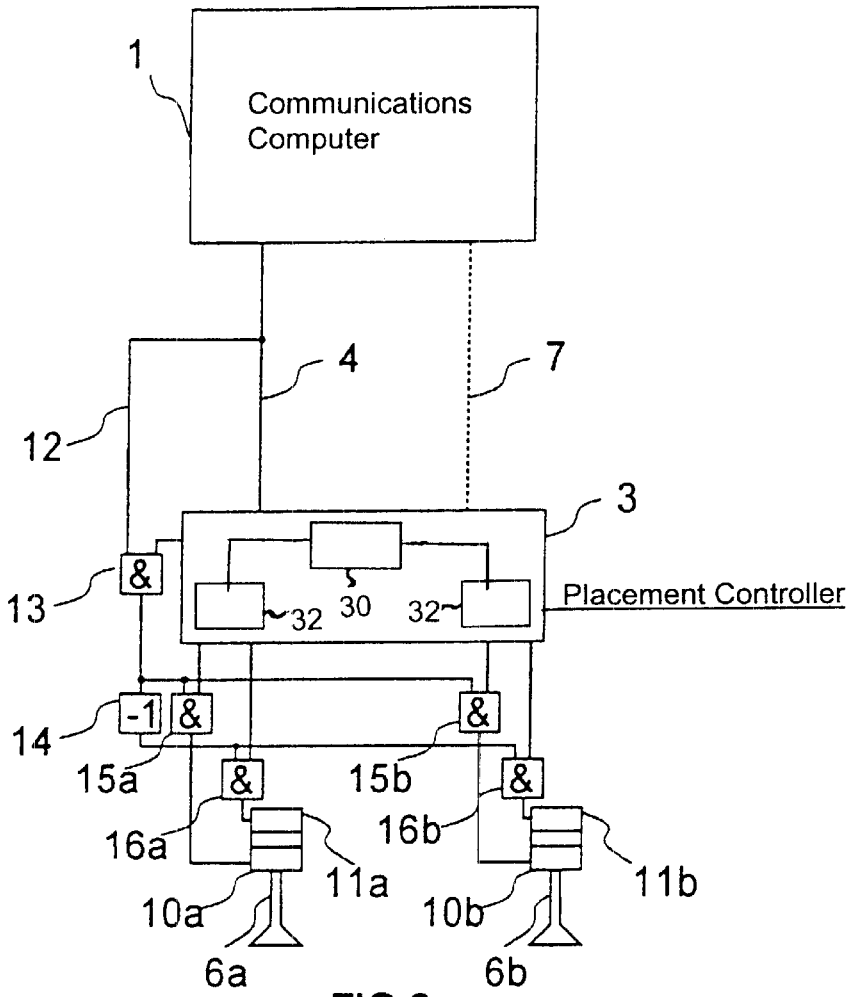
FIG. 2 is a block diagram of a circuit for the actuation of two charge cycle valves by a placement control element in conjunction with the communications computer.

FIG. 2 illustrates in more detail an exemplary actuation connection between the placement control element 3 and the valves 6*a*, 6*b*. Closing coils 11*a*, 11*b* of the charge cycle valves 6*a*, 6*b* are connected, via one AND element 16*a*, 16*b* each, to the output stages 32 integrated in the placement control element 2, 3. Alternatively, the AND elements 16*a*, 16*b* can also be provided in an actuation device of the output stages. The second input of the AND elements 16*a*, 16*b* is connected via an inverter 14 to a branch 12 of the communications line 4 for the timing signal TS which the communications computer 1 feeds to the placement control element 3. An AND element 13 whose second input is activated by the placement control element 3 is also connected into the branch 12.

In a similar way, the opening coils 10*a*, 10*b* of the charge cycle valves 6*a*, 6*b* are connected via AND elements 15*a*, 15*b* to an output of the AND element 13, no inverter 14 being provided here.

Figure 3:
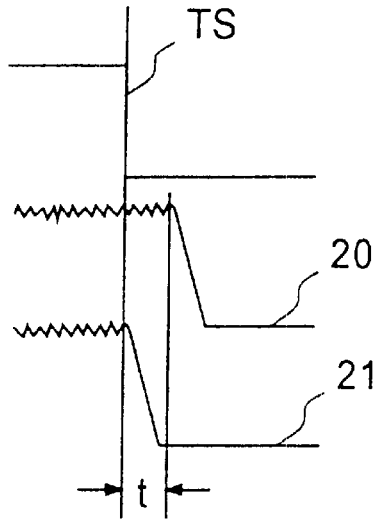
FIG. 3 is a graph of a timing profile of a timing signal and an energization actuation of a charge cycle valve for various operation states.

The method of operation of the circuit is now described. If the placement control element 3 enables the AND element 13 by a suitable high level signal, the timing signal TS is present at its output, in the same way as it is fed by the communications computer 1 to the placement control element 3 for the valves 6*a*, 6*b* via the communications line 4. A trailing edge of the timing signal TS is illustrated in FIG. 3; it constitutes an instruction to close the output valves 6*a*, 6*b*. If the placement control element 3 detects the trailing edge of the timing signal TS, it normally takes a certain amount of time t until the energization of the respective winding, in this case of the windings 10*a*, 10*b* of the closing coils, is terminated. The time offset t is due to program running times in the processor 30 of the placement control element 3 and due to time constants of the actuation. The resulting time profile of the energization of the windings 10*a*, 10*b* is illustrated by curve 20 shown in FIG. 3. If the placement control element 3 has enabled the AND element 13, the trailing edge of the timing signal TS brings about a premature end of energization of the opening coils via the AND elements 15. The energization profile illustrated schematically in curve 21 is obtained at the windings 10*a*, 10*b* as shown in FIG. 3. As is shown in FIG. 3, the energization then ends without the timing offset t.

This embodiment makes it possible for the placement control element 3 to allow a direct effect of the timing signal TS on the energization of the windings 10*a*, 10*b*, 11*a*, 11*b* via the AND element 13. The communications computer 1 can therefore instruct the placement control element 3, via the SPI-BUS 7 and as a function of the operating state, to enable the direct effect of the timing signal TS.

As a result of the inverter 14 in the wiring of the second inputs of the AND elements 16, a behavior which is inverse with respect to the opening coils is obtained for the windings 11*a*, 11*b* of the closing coils, and at the same time energization of the windings 11*a*, 11*b* of the closing coils is enabled. The placement control element 3 can then suitably initiate the energization of the closing coils.

The described actuation can be provided in all the placement control elements 2, 3.

The independent placement control elements 2, 3 are advantageously provided for the inlet valves 5*a*, 5*b* and the outlet valves 6*a*, 6*b* of each cylinder, but another division is also possible, in particular a single placement control element can satisfy the requirements. Furthermore, in addition to the communications computer 1, at least one further communications computer may also be provided, it being possible, for example, to provide a separate communications computer for all the inlet valves 5 and all the outlet valves 6 of the internal combustion engine. As a result of this configuration, a certain degree of redundancy is obtained because, if one of the communications computers fails, the other can take over the functions of the failed one.

We claim:

1. A circuit for controlling valves, including at least one electromechanically activated inlet valve and at least one electromechanically activated outlet valve, of a cylinder of an internal combustion engine, the circuit comprising:

at least one placement control element having a plurality of output stages connected to electromagnets of the valves, at least one of said output stages connected to each of said electromagnets of the valves, said placement control element receiving timing signals and valve position signals, said placement control element actuating said output stages in dependence on the timing signals and, while processing the valve position signals for indicating a position of the valves, said placement control element regulates an energization of the electromagnets to bring about a gentle, low-noise placement of each of the valves to an end position;

a digitally operating communications computer for evaluating a crankshaft position signal and connected to said placement control element; and a communications connection for connecting said communications computer to an operational control unit of the internal combustion engine, said communications computer exchanging data over said communications connection to the operational control unit and generates the timing signals received by said placement control element in dependence on the crankshaft position signal and of the data received from the operational control unit.

2. The circuit according to claim 1, wherein said placement control element is one of a plurality of placement control elements and one of said placement control elements is coupled to the inlet valve and another of said placement control elements is coupled to the outlet valve.

3. The circuit according to claim 1, wherein said placement control element has a processor; and including a bi-directional communications interface connecting said communications computer to said placement control element for exchanging further data.

4. The circuit according to claim 2, wherein each of said placement control elements detects a position of the valves and signals a malfunction of one of the valves to said communications computer.

5. The circuit according to claim 2, wherein said communications computer monitors at least one of a temperature of said output stages, a supply voltage of said output stages, a supply voltage of position sensors used, and a supply voltage of all of said placement control elements.

6. The circuit according to claim 1, wherein said communications computer is one of a plurality of communications computers.

7. The circuit according to claim 6, wherein the inlet valve is one of a plurality of inlet valves and the outlet valve is one of a plurality of outlet valves, and one of said communications computers is provided for all of the inlet valves and another one of said communications computer is provided for all of the outlet valves.

8. The circuit according to claim 2, including a housing and an active cooling system connected to said housing, said plurality of placement control elements are disposed with said output stages in said housing.

9. The circuit according to claim 4, wherein if a valve failure is indicated by one of said placement control elements, said communications computer brings about a deactivation of the other valves of the cylinder in question to a closed position.

10. The circuit according to claim 2, wherein the electromagnets each have a winding resulting in a plurality of windings;

including a feedline connected to each of the windings resulting in a plurality of feedlines; and including a logic circuit disposed in said feedlines, said logic circuit receiving an associated timing signal so that said logic circuit brings about, directly by the associated timing signal, a direct shutting down of energization of an associated winding.

11. The circuit according to claim 10, including a communications line connecting said communications computer to said placement control element;

wherein said logic circuit has first AND elements, one of said first AND elements connected in each of said feedlines to a respective winding and each of said first AND elements having an output connected to the respective winding, a first input connected to said placement control element and a second input; and wherein said logic circuit has a second AND element having a first input connected to said communications line, a second input connected to said placement control element, and an output connected to said second input of each of said first AND elements so that, when said second AND element is enabled by said placement control element, a respective one of the timing signals brings about a direct shutting down of the energization of the respective winding.

* * * * *

UNITED STATES PATENT AND TRADEMARK OFFICE

CERTIFICATE OF CORRECTION

PATENT NO. : 6,505,113 B2 
DATED : January 7, 2003
INVENTOR(S) : Volker Eichenseher et al.

It is certified that error appears in the above-identified patent and that said Letters Patent is hereby corrected as shown below:

Title page,
Item [73], Assignee, should read as follows:
-- Siemens Aktiengesellschaft, München (DE)
Bayerische Motoren Werke Aktiengesellschaft, München (DE) --

Signed and Sealed this

Nineteenth Day of August, 2003

JAMES E. ROGAN
*Director of the United States Patent and Trademark Office*